United States Patent [19]

Kotchy

[11] 4,286,384

[45] Sep. 1, 1981

[54] PANELING CUTTER TOOL

[76] Inventor: Alan W. Kotchy, 628 Garrison Ave., Nekoosa, Wis. 54457

[21] Appl. No.: 41,252

[22] Filed: May 21, 1979

[51] Int. Cl.[3] ..... B26B 29/00

[52] U.S. Cl. ..... 30/287; 30/299; 30/279 R

[58] Field of Search ..... 30/287, 289, 299, 279 R

[56] References Cited

U.S. PATENT DOCUMENTS

| | | | |
|---|---|---|---|
| 185,281 | 12/1876 | Bissell | 30/287 |
| 611,408 | 9/1898 | Frueh | 30/287 |
| 776,691 | 12/1904 | Sanborn | 30/287 |
| 1,166,277 | 12/1915 | Thompson | 30/287 |
| 1,211,777 | 1/1917 | Stanfield | 30/287 |
| 1,915,636 | 6/1933 | Wendelken | 30/287 |
| 1,956,275 | 4/1934 | Cook | 30/299 |
| 1,995,887 | 3/1935 | Kimball | 30/289 |
| 2,038,884 | 4/1936 | Chalmer | 30/287 |
| 2,649,656 | 8/1953 | Hedrick | 30/287 |
| 2,650,532 | 9/1953 | Moldowan | 30/299 |
| 3,596,356 | 8/1971 | O'Neal | 30/279 |
| 4,064,626 | 12/1977 | Meshulam et al. | 30/287 |
| 4,180,908 | 1/1980 | Beermann | 30/287 |

FOREIGN PATENT DOCUMENTS

| | | | |
|---|---|---|---|
| 757574 | 9/1956 | United Kingdom | 30/299 |

*Primary Examiner*—Nicholas P. Godici
*Assistant Examiner*—J. T. Zatarga
*Attorney, Agent, or Firm*—Andrus, Sceales, Starke & Sawall

[57] ABSTRACT

A manually actuated tool for cutting openings in sheet paneling from the room side after the paneling is secured in place. The basic construction consists of a pair of cooperating sharp blades at the forward end of the frame of the tool located in overlapping relation so that one blade is a leading blade and the other a trailing blade. Under the method of the invention the opening to be cut in the paneling when it is secured in place is laid out by initially securing a wire or wires around the backing over which the paneling will later be placed and then using a magnetic device after the paneling is in place to locate and mark the outline of the opening on the front of the paneling. The tool is then manually moved over the marked outline on the paneling to cut out the portion of the paneling to be removed.

6 Claims, 9 Drawing Figures

Fig. 1
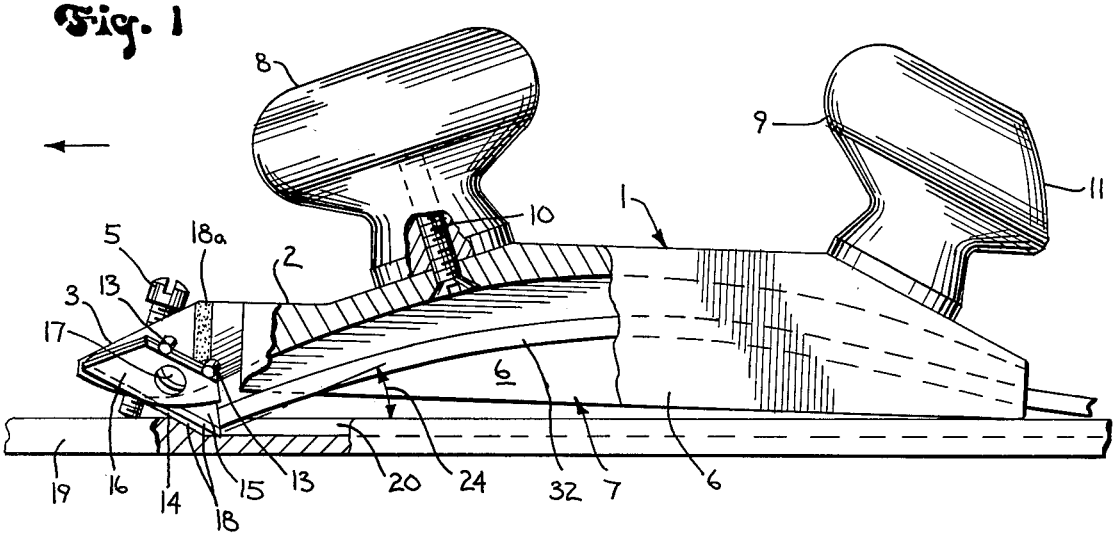
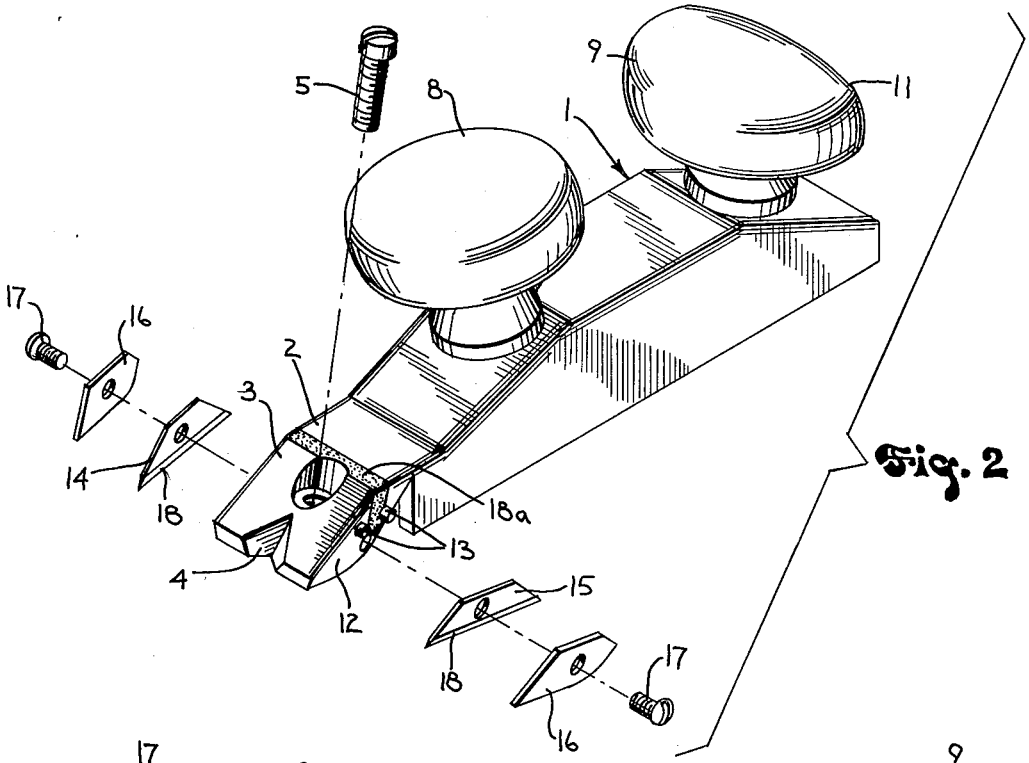
Fig. 2
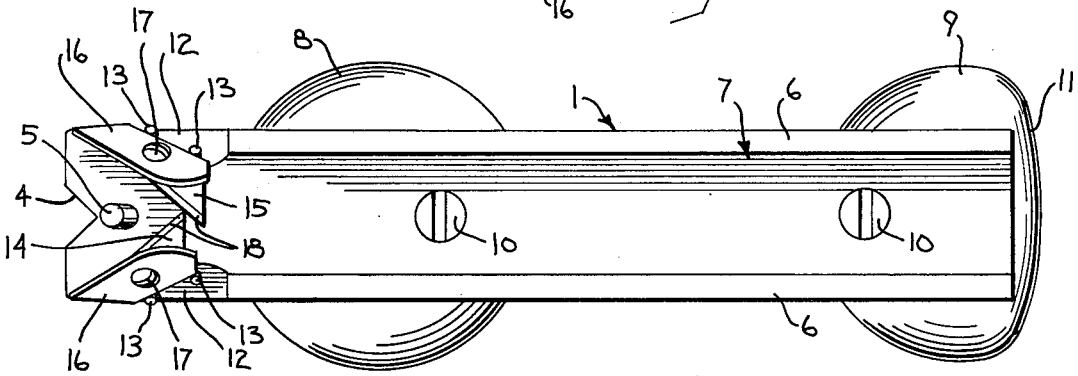
Fig. 3

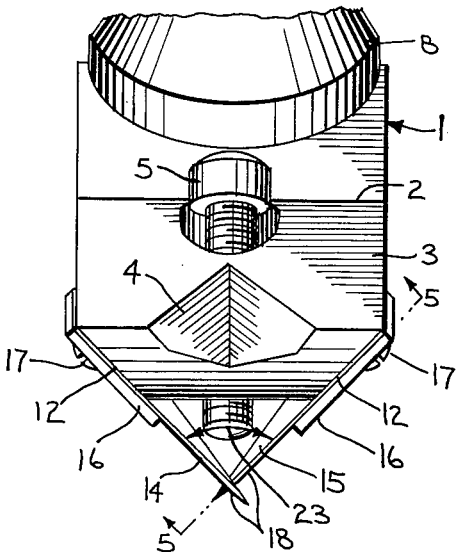
Fig. 4
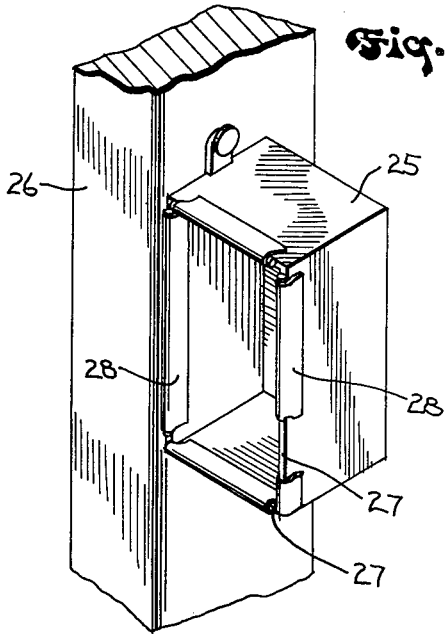
Fig. 7
Fig. 6
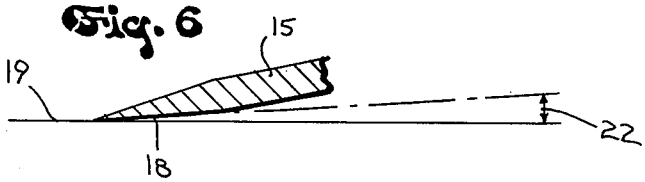
Fig. 8
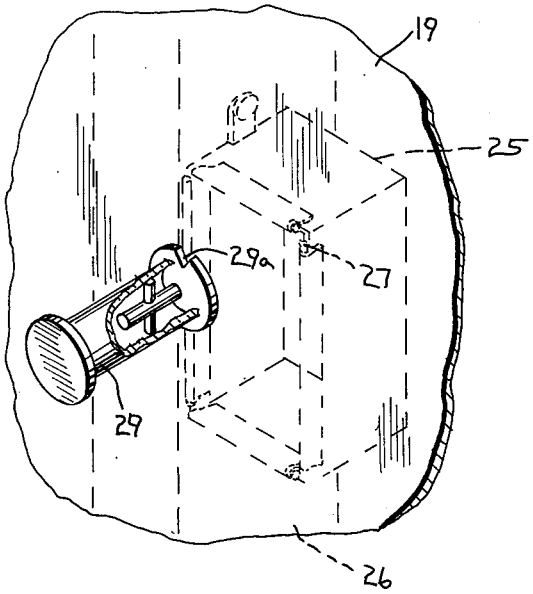
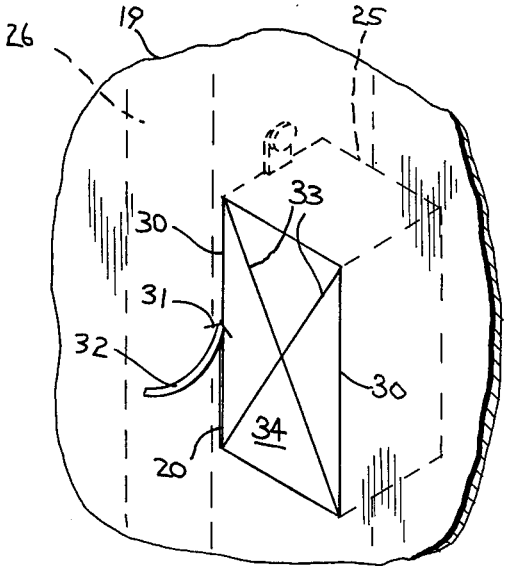
Fig. 9
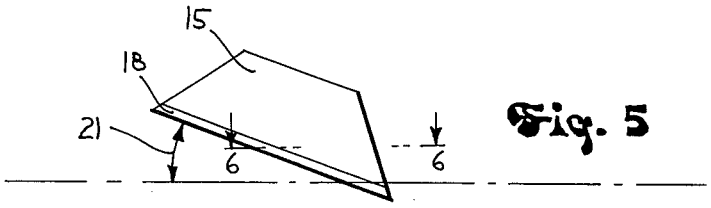
Fig. 5

PANELING CUTTER TOOL

BACKGROUND OF THE INVENTION

The invention is directed to the cutting of sheet paneling for openings such as doors, windows, heating registers, light switches, electrical outlets and the like. Under current procedures measurements made of these objects are first laid out on the paneling, generally on the back side of the paneling in the reverse order and the openings are then sawed out. This procedure is cumbersome and errors in measurements are easily made. The present improvement is directed to a method of marking the paneling for openings on the room side of the paneling and then using a tool for cutting the paneling after the paneling is on the wall along the marked line to expose the electrical outlet or other unit which has been outlined on the front of the paneling.

SUMMARY OF THE INVENTION

In carrying out the invention, before the paneling is installed, a strip or strips of a soft steel wire or other steel or metal material which may be taped or otherwise held around the opening such as of an electrical outlet which has been installed in the building backing to which the paneling is to be secured. In the event the outlet or other backing is of metal, the marking material is not required. The paneling is then located over the outlet and secured in place. A magnetic or other type of finder is then employed to locate the wire. The extent and location of the wire is then marked by pencil or the like on the room side of the paneling. The cutter tool of the invention is then manually moved over the markings outlining the outlet to cut a V-shaped groove of considerable depth. The blades located at the forward end of the tool intersect or overlap with one of the blades operating as a leading edge and one as a trailing edge. Normally blade stiffeners are used to back up the blades although heavier blades can be used. Also the cutting edge may be on only one side of a blade. The respective planes of each blade are set at a predetermined angle with respect to each other to provide a V-shaped cut of approximately 90 degrees.

A notch at the forward end of the tool permits the operator to locate the markings on the paneling and an adjustable depth control screw or the like extends through the forward end of the frame of the tool and can be set at the depth desired for the cut of the V-shaped groove. The cut is normally made without cutting through the paneling. After completing the cut around the perimeter of the opening being formed in the paneling, the cutout paneling portion may be removed in a number of different ways. The tool can be pulled as well as pushed for making the paneling cut and the underside of the tool is of a channel shape so that chips or strips cut from the groove are readily disposed of to the rear of the tool.

BRIEF DESCRIPTION OF THE DRAWINGS

FIG. 1 is a side elevational view of the tool of the invention in cutting position on paneling with parts broken away and sectioned;

FIG. 2 is an exploded perspective view illustrating the various parts of the tool;

FIG. 3 is a bottom elevational view of the tool;

FIG. 4 is a front elevational view of the tool;

FIG. 5 is a schematic view taken along line 5—5 of FIG. 4;

FIG. 6 is a section taken on line 6—6 of FIG. 5 looking along the blade;

FIG. 7 is a view illustrating the attachment of an electrical outlet box to studding with the wires marking the outline of the box taped to the edges of the box;

FIG. 8 is a view with the paneling in place over the electrical outlet box and illustrating the use of a magnet for locating the wires outlining the box for marking their location on the paneling; and FIG. 9 is a view illustrating the cutting of the paneling along the lines outlining the perimeters of the outlet box for removal of the cutout panel portion to provide an opening in the paneling to expose the outlet box.

DESCRIPTION OF THE PREFERRED EMBODIMENT

Referring to the drawings there is illustrated a manually operated tool which is employed to cut V-grooves or the like in wall paneling. The tool has a frame 1 of a contoured bowed construction on the top and terminates at the forward end, as illustrated in the drawing, initially in a straight forwardly extending platform 2 and thence in a downwardly tapered surface 3. A V-notch 4 is provided in tapered surface 3 at the forward end of the tool which acts as a guide for the operator in the forward movement of the tool. An adjustable control member or depth screw 5 extends through the tapered surface 3 for vertical adjustment of the tool to different positions to control the depth of the cut of the tool.

The bottom of frame 1 is bordered by the downwardly extending sides 6 which form a channel 7 to confine the chips or strips which are cut by the tool as it is operated.

The tool is actuated by a forwardly located knob 8 and a rear knob 9 which are shown as secured to the top of frame 1 by screws 10 or the like. The knobs and frame of the tool could be of one piece construction. Rear knob 9 has a flattened surface 11 at the rear so that when the knobs are grasped by the operator to push the tool forwardly, one hand engages the flattened surface 11 of rear handle 9 to strike the tool to move it forwardly more effectively in some uses of the tool. The flattened surface 11 is primarily significant in creating a short cut at the end of a long cut where the operator can strike the surface 11 with the heel of his hand to accurately inch the tool forwardly to eliminate possible overcutting.

At the forward end of the tool the respective opposite undersides 12 of the tapered surface 3 taper downwardly and inwardly of the tool. A pair of spaced pins or abutments 13 are secured to the respective sides 12. The cutting blades 14 and 15 abut the tapered sides 12 below abutments 13 and are backed by stiffeners 16 which overlie a portion of blades 14 and 15 and also abut pins 13. A screw 17 extends through each stiffener and each respective blade 14 and 15 to secure the blades in a predetermined location to the sides 12 of the downwardly inwardly tapered surfaces 3. Rotation of stiffeners 16 and blades 14 and 15 when the screws 17 are threaded home is prevented by the abutments 13. Blades 14 and 15 and stiffeners 16 are shaped to fit the tapered sides 12 with the cutting ends of the blades projecting downwardly and inwardly from sides 12.

The cutting ends of blades 14 and 15 which terminate in a generally sharp end portion 18 are of a generally triangular shape and face the direction in which the tool is to be moved by the workman. Blades 14 and 15 intersect or overlap and blade 14 is the leading blade as it extends ahead of blade 15 which is the trailing blade. The tips of blades 14 and 15 may be indicated on the forward end of the frame of the tool by the line 18*a*. The depth of the groove cut by the blades in a paneling 19 is controlled by the depth control screw 5 which can be threaded to various height positions in engagement with paneling 19. The respective sides 6 of frame 1 of the tool terminate slightly rearwardly of cutting blades 14 and 15 so that the strips or chips cut from the V-groove 20 which are formed pass into channel 7 and out the rear of the tool without troubling the operator and the actuation of the tool.

Blades 14 and 15 are oriented to a slicing angle on the order of twenty degrees when the tool is operated properly. A small slicing angle is important to insure that the paneling does not splinter as it is cut. The slicing angles are the angles, as indicated schematically by 21 in FIG. 5 of the drawings, between the edges of the blades and the respective lines of the surfaces of the paneling 19 which is about to be cut.

In addition the orientation of the blades in the construction of the tool provides on the order of five or six degrees clearance or relief angle 22, as shown in FIG. 6 of the drawings, on the back side of the blades to allow blades 14 and 15 to easily enter the area of paneling 19 to be cut and more readily generally stay in the cut as it is made. The relief angle is generally taken looking along the plane of the blade, and now more precisely the plane of the beveled edge if an outside beveled edge is used.

The respective planes of each blade 14 and 15 are at an angle of the order of seventy-five degrees, as indicated approximately at 23 in FIG. 4 of the drawings. This angle is measured in a plane perpendicular to the line of intersection of blades 14 and 15. The line of intersection of blades 14 and 15 is at an angle of the order of twenty three degrees with respect to the paneling, as indicated at 24 in FIG. 1 of the drawings. The result is that the cut in paneling 19 made by blades 14 is of the V-shaped groove 20 of approximately ninety degrees.

The angles described may be varied slightly within predetermined more or less degrees and the examples given in the drawings have worked successfully and represent the best mode of the construction and operation of the tool of the invention.

The method of accomplishing the cutting of a desired opening in paneling 19 after it is in place is an important aspect of the invention.

The method of the invention is applicable for providing many types of required openings in paneling such as doors, windows, heating registers, light switches, outlets and the like. By way of illustration there will be described the method for providing an opening for the metal electrical outlet 25 which is shown in the drawings as secured to the stud 26.

Before paneling 19 is secured in place to stud 26, a strip of soft steel wire or metal or other suitable flux responsive element 27 is secured around the outlet by strips of tape 28 to outline the opening in paneling 19. The outlet opening 25 is relatively small and the metal element 27 extends substantially completely about the opening. If the opening is substantially larger, such as for a door or window, the metal elements need be applied only in the corner positions for defining the opening. For convenience of applying the tool the worker will normally connect the corner markings using a straight edge or the like.

Paneling 19 is then installed and secured in place over electrical outlet 25. In order to locate the opening, the workman then passes a magnetic finder 29 or other metal detecting device over the installed paneling to locate the wire 27 which outlines electrical outlet 25. The workman ordinarily then makes a mark as guided by the notch 29*a* of finder 29 at several locations on paneling 19 over the wire extending around the opening. A straight edge or the like is then used to draw the lines 30 on the paneling 19 which marks the opening on paneling 19 for electrical outlet 25.

The tool of the invention is then pushed by the workman over the paneling along the lines 30 to cut the V-shaped groove 20 around the opening. In cutting V-groove 20 the cut is not ordinarily made all the way through the paneling 19.

The tool is normally held with one hand on the forwardly located knob 8 and one hand on the rear knob 9, but may be struck on the flat surface 11 by the other hand to inch the tool forwardly over paneling 19 when making a short cut or at the end of a long cut. This procedure exhibits the greatest amount of control of the cut. However, when a long cut is made, the tool ordinarily is merely pushed along the paneling 19 to cut the V-notch 4. As the tool is pushed away from the workman, as indicated in FIG. 7 by the arrow 31, he must insure that the marked lines 30 remain aligned with the V-notch 4 at the front of the tool.

Under the best practice, usually necessary for the first cut only, instead of lifting the tool from the work at the end of a cut, as this will normally cause splintering of paneling 19 because the shavings or strips 32 often are still attached to blades 14 and 15, the tool may be pulled straight back and strip 31 can then be broken off at the desired place without splintering the paneling. After a first cut, all following cuts which terminate in a previous cut automatically sever the strip and lifting of the tool will not cause any damage.

After the workman cuts around the perimeter of the opening, normally cross cuts 33 are made across the face of the cutout paneling portion 34 to be removed. The intersection of paneling port 34 can then be struck with a hammer or the like and this will split the pieces making up paneling portion 34 and generally loosen them sufficiently so that they can be broken out by hand.

If the cutout is to be saved, such as with a large opening such as for a door or window, then the cross cuts 34 are not made. Instead the workman follows along the V-shaped groove 20 with a utility knife until the cutout paneling portion 34 is separated from paneling 19.

In either of the described procedures, the splinters can be removed and the opening generally cleaned up with a utility knife. The wire 27 is also removed and the paneling 19 is then installed in place to expose the opening to outlet 25.

The depth control member or screw 5 when the tool is initially placed on the paneling 19 engages the strip 32 of the paneling which is to be removed from V-shaped groove 20 and this prevents any injury to paneling 19 around the opening which is being cut for outlet 25.

The tool has been described as one which has been pushed forwardly by the operator. It is obvious that the construction could be reversed and the tool pulled toward the operator as well as pushed. Under another construction a single handle could be used to actuate the tool or the tool could be power operated. However, it has been experienced that pushing of the tool away from the operator provides the best use of the tool because it has definite advantages in safety and controlability.

The invention provides a novel reliable tool and a manner in which to cut an opening in paneling after the paneling is in place.

Various modes of carrying out the invention are contemplated as being within the scope of the following claims particularly pointing out and distinctly claiming the subject matter which is regarded as the invention.

I claim:

1. A cutting tool for cutting an opening in sheet paneling after the paneling has been secured in place, which comprises a frame having a curvilinear top portion terminating at the forward end of the tool in a downwardly tapered surface having downwardly tapered sides, cutting blades secured to the opposite tapered sides and terminating in sharp overlapping edges, and which face in the direction in which the tool moves and which project in a direction facing the rear of the tool, and laterally spaced side members extending downwardly from the top portion of the tool and disposed to engage the surface of the paneling upon which the tool is used and providing a central channel in the bottom of the frame through which a strip cut from the paneling to form a groove can move for discharge from the rear end of the tool.

2. The cutting tool of claim 1, and the pair of cutting blades having a triangular shape approaching the sharp overlapping edges so that the groove being cut in the paneling is of V-shape.

3. The cutting tool of claim 1, an upstanding knob secured to the downwardly tapered forward end surface and receiving one hand of the workman, said curvilinear top portion terminating at the rear end of the tool in a second downwardly tapered surface, a second upstanding knob secured to the second downwardly tapered rear end surface portion of the tool, and a flat surface provided on the outer end of the rearwardly located knob and located in an essentially vertical plane for more readily supporting the hand of the workman pushing the tool forwardly and adapted to be struck by the heel of an operator's hand to inch the tool forwardly in an accurately controlled movement and without injury to the hand.

4. The cutting tool of claim 1, and a stiffener backing each blade, and the blades being secured in place and threaded means extending through the blades and the stiffeners to secure them together and to the tapered sides of the extension.

5. The cutting tool of claim 4, and spaced abutments secured to the tapered sides and abutted by the blades and stiffeners to prevent rotation of the blades and stiffeners in service.

6. The cutting tool of claim 1 and tapered sides to which the blades are attached at predetermined angles with respect to each other and with respect to the motion of the tool so as to allow a small relief or clearance angle on the rearwardly side of the blades as it moves through the material.

* * * * *

UNITED STATES PATENT AND TRADEMARK OFFICE

CERTIFICATE OF CORRECTION

PATENT NO. : 4,286,384

DATED : September 1, 1981

INVENTOR(S) : ALAN W. KOTCHY

It is certified that error appears in the above-identified patent and that said Letters Patent are hereby corrected as shown below:

Column 4, line 45, Cancel "port" and substitute therefor ---portion---

Signed and Sealed this

*Sixteenth* Day of *February 1982*

[SEAL]

*Attest:*

GERALD J. MOSSINGHOFF

*Attesting Officer*

*Commissioner of Patents and Trademarks*